United States Patent [19]

Delerue

[11] 3,982,706

[45] Sept. 28, 1976

[54] WINDING MACHINES HAVING INDEPENDENT SPINDLES

[76] Inventor: Dominique Delerue, 43, rue de la Briqueterie, 59240 Mouvaux, France

[22] Filed: Nov. 10, 1975

[21] Appl. No.: 630,215

[30] Foreign Application Priority Data

| | | |
|---|---|---|
| Nov. 12, 1974 | France | 74.40649 |
| Nov. 12, 1974 | France | 74.40650 |
| Jan. 30, 1975 | France | 75.03634 |

[52] U.S. Cl. ..... 242/18.1; 242/18 DD; 242/43.1

[51] Int. Cl.[2] ..... B65H 54/38

[58] Field of Search ..... 242/18 R, 18 DD, 18.1, 242/43 R, 43.1

[56] References Cited

UNITED STATES PATENTS

| | | | |
|---|---|---|---|
| 1,899,651 | 2/1933 | Swanson | 242/18.1 |
| 1,915,241 | 6/1933 | Reece | 242/18.1 |
| 1,946,506 | 2/1934 | Swanson et al. | 242/18.1 |
| 1,955,778 | 4/1934 | Swanson | 242/18.1 |
| 2,087,439 | 7/1937 | McKean | 242/18.1 |
| 3,884,426 | 5/1975 | Hermanns | 242/43.1 |
| 3,948,453 | 4/1976 | Abbott | 242/18.1 X |

*Primary Examiner*—John Petrakes
*Attorney, Agent, or Firm*—Martin A. Farber

[57] ABSTRACT

In a winding machine having independent spindles with a grooved yarn-guide driving bobbins preventing winding irregularities, winding bobbins at high speeds from conventional or sectional hanks, cops, cakes or the like, namely winding machines having a conical bobbin which rests on a cylindrical yarn-guide having helical grooves generally with two opposing pitches which distributes the yarn uniformly on the bobbin, the latter resting under its own weight above the yarn-guide which drives the bobbin by frictional resistance, the axis of the bobbin moving progressively away from that of the yarn-guide as the yarn is being wound while forming normally in a plane common to the two axes a small or zero angle with the axis of the cylindrical yarn-guide, including a device for preventing the yarn from collecting at certain preferential points of the bobbin at certain winding speeds, and including a yarn break detector, the improvement comprising a device for oscillating at least one of the ends of the shaft of the yarn-guide and of the bobbin with an alternating relative oscillatory movement substantially perpendicular to a plane defined by the axes of the bobbin and of the yarn-guide, when they are in this plane, without causing any substantial vertical oscillation of the bobbin. A modulated action device accompanies the oscillation of the yarn-guide or of the bobbin for retaining the yarn in a groove of the yarn-guide for any operative position of the axis of the yarn-guide with respect to the axis of the bobbin. The modulated action device is combined with a device for preventing a faulty movement of the yarn with respect to the axis of the bobbin both at a time of starting and at a time of braking, comprising a torque converter for providing a uniform and moderate torque on the yarn-guide at the time of starting, an automatic braking device for intensive simultaneous stopping of the control motor, of the bobbin, and of the yarn-guide and the members which actuate it as soon as an exaggerated traction is exerted by the yarn which is supplied, the automatic braking device braking the bobbin abruptly and with priority, and a device for tensioning the feed yarn for preventing slipping thereof.

27 Claims, 16 Drawing Figures

WINDING MACHINES HAVING INDEPENDENT SPINDLES

The present invention relates to improvements to winding machines having independent spindles with a grooved yarn-guide driving the bobbins, eliminating winding irregularities, winding bobbins at high speed from conventional or sectional hanks, cops, cakes or the like, namely winding machine for a conical bobbin, which bears against a cylindrical yarn-guide having helical grooves, generally with two opposing pitches, which distributes the yarn uniformly on the bobbin, the latter resting under its own weight on top of the yarn-guide which drives it by simple adhesion, the axis of the bobbin moving progressively away from that of the yarn-guide as the yarn is wound, thus normally forming, in the plane common to the two axes, a small or zero angle with the axis of the cylindrical yarn-guide, a device being provided for preventing the yarn from collecting at certain preferential points of the bobbin, at certain winding speeds, said winding machines having a conventional yarn break detector.

This type of winding machine is well known, but it has certain drawbacks when the yarn becomes tangled adjacent the hank for example and engages in the form of bundles adjacent the winder, thus causing a blockage. The yarn almost alway breaks, since even if a safety device stops the winding machine, in view of the high winding speed and the large diameter of the bobbins, the inertia of the latter causes exaggerated traction on the yarn. If the yarn does not break, then the edges of the bobbin may collapse.

However, when using winding machines having individual spindles, with individual motors, starting-up of the yarn-guide driving the bobbin may be too abrupt, in particular with the oscillation system of the yarn-guide as provided on this winding machine. In fact, in certain oscillation positions of this yarn-guide, the bobbin rests solely on a small part of its generatrix and, when starting-up is too abrupt, substantial slipping between the bobbin and yarn-guide occurs, especially at high speed and heating of the material thus occurs, so that the latter is damaged, plasticization occurs particularly in the case of synthetic yarn.

This is why it is preferable for the starting to be gradual. But if the starting of the yarn-guide is to be gradual, it is also necessary that its braking in the case of excess tension on the yarn is efficient, otherwise since the bobbin would be stopped before the yarn-guide, there would also be a risk of heating of the material on the yarn-guide and of damage to the material.

There are the various drawbacks which the winding machine of the invention proposes to eliminate.

According to the invention, the winding machine is characterised by the fact that at least one of the ends of the shaft of the yarn-guide and bobbin receives an alternating relative oscillatory movement substantially perpendicular to the plane defined by the shafts of the bobbin and yarn-guide, when they are in this plane, said oscillatory movement being such that it causes virtually no appreciable vertical oscillation of the bobbin, the oscillation of the yarn-guide or bobbin being accompanied by means having a modulated action for retaining the yarn in the groove of the yarn-guide whatever the position of the shaft of the yarn-guide with respect to the shaft of the bobbin, the aforesaid means being combined with means preventing the inopportune movement of the yarn with respect to the bobbin both at the time of starting and braking, namely:

A torque converter defining a torque on the yarn-guide at the time of starting, which is as uniform and moderate as possible, automatic means for powerful simultaneous stoppage
of the control motor
of the bobbin
and of the yarn-guide with all the members which actuate the latter, as soon as exaggerated traction is exerted by the supply yarn, said means braking the bobbin as a priority and abruptly, means for tensioning the feed yarn preventing slipping.

The torque converter used is designed to provide low torque upon starting the machine but, on the other hand, to provide considerable resisting torque during braking of its driving part. To this end, one would use a converter of the type having oscillating jaws for example, applied, under the effect of the centrifugal force, against the inside of a drum and in which the jaws are integral with the driven part of the converter, their action is constantly assisted by springs having an adjustable force and their arrangement is such that a wedging effect occurs, considerably increasing the torque transmitted by the converter during its restraining operation with respect to its driving operation.

According to a preferred embodiment, the shaft of the yarn-guide will be made to oscillate solely adjacent the small diameter of the bobbin. Furthermore, to produce the means having a modulated action, a movable tensioning guide is disposed before the inlet of the yarn into the grooved yarn-guide, said tensioning device being inclined so as to produce a greater tensioning effect towards the small end of the bobbin and receiving oscillations according to those of the moving end of the yarn-guide. These means having a modulated action may also be constituted by a movable tensioning yarn-guide disposed before the inlet of the yarn into the grooved yarn-guide, said tensioning guide being inclined in order to produce increasing tensioning of the yarn towards the small end of the bobbin and combining two superimposed movements intended to control the tensioning, namely:

a. oscillations according to those of the moving end of the yarn-guide, b. progressive divergence of the yarn-guide as the bobbin becomes larger.

The divergence of the tensioning guide with respect to the yarn-guide varies rapidly as the bobbin begins to enlarge, in order to stabilise throughout the winding of the remainder of the bobbin.

According to a preferred embodiment, the control of the various braking operations takes place by a yarn loop formed between a return pulley and the end of a resilient oscillating lever, excess tension of the yarn shortening the loop and causing the lever to oscillate, which actuates the various stopping and braking operations. It is appropriate to produce this braking of the bobbin by means of a finger member actuated by the oscillating lever and which engages in a resilient ring integral with the bobbin and concentric with respect to the latter, this means being well suited to a braking force of the bobbin which increases as the bobbin becomes larger.

The yarn feed device used in the winding machine of the invention and which is actuated in synchronism with the yarn-guide is placed between the loop and said yarn-guide, said feed device being constituted by a diabolo in the manner of a sheave having staggered projections, the winding sector of the yarn on the pulley being determined by an adjustable guide.

As seen previously, several members of the winding device are braked strongly and in particular, the motor which is braked powerfully by a ribbon brake actuated mechanically by the above-mentioned oscillating lever. To this end, a device is provided for multiplying the force between the oscillating lever controlled by the yarn loop and the braking finger member acting on the bobbin. According to a preferred embodiment, the device for multiplying the force is constituted by the particular mounting of the return spring of the oscillating lever which passes through a position of unstable equilibrium, beyond which it acts in the same direction as the yarn loop.

To clarify what was said above as regards the oscillation of the yarn-guide, at least one of the shafts of the yarn-guide oscillates about one of its ends, an alternating movement being imparted to its other end, ensuring oscillation under the desired conditions. The other end of the oscillating shaft of the yarn-guide is pivoted about a universal joint ensuring the rotation of said oscillating shaft from a shaft which is not subject to the oscillatory movement.

In this case, the shaft which is not subject to oscillation, does not rotate and is connected to the oscillating shaft of the yarn-guide by a bearing comprising a ball and socket joint fitted in the fixed shaft about which a pulley free to rotate on said shaft, provided with lugs engaged in apertures in a circular ring fixed on the oscillating shaft, ensures the dirve of the latter. The circular ring partly covers a circular shoulder of the loose pulley on which are disposed the lugs engaged in the apertures of the ring. A flexible circular gasket is disposed between the base of the circular ring and the end of the circular shoulder of the loose pulley. A needle bearing is arranged between the loose pulley and a shoulder of its rotary shaft, against which the pulley is pressed by the resilient gasket. The end of the oscillating shaft of the yarn guide is fixed in a bearing having a ball and socket joint fitted in an oscillating bearing.

The winding machine of the invention comprises a yarn feed device having a grooved pulley, possibly where the base of the groove is winding, said pulley being driven in rotation in order to pull a thread which winds partly around the latter, guided by at least one yarn-guide, at the outlet and by the source of yarn at the inlet. The yarn feed device of this winding machine comprises a fixed means or "cover" covering the pulley over the sector which is not covered by the yarn, this means coming as close as possible to the yarn and the pulley without touching them, in particular at the point where said yarn leaves the pulley. To clarify the idea, the means or cover covering the pulley follows the shape of the latter and adjacent the yarn outlet, is in the shape of a ladle engaging in the groove in the pulley, whilst coming as close as possible to the point where the yarn leaves the base of this groove. According to a preferred embodiment, the means or cover covering the pulley are extended in the form of a curved fork beyond the ladle above the edges of the pulley.

It is suitable that the means or cover covering the pulley is retained by a support which may be adjusted in rotation by pivoting about the axis of the pulley, and it is extended beyond its support, in the opposite direction to the ladle, in order to partly cover the pulley at the yarn inlet side.

Finally, the part of the means or cover covering the pulley adjacent the yarn inlet, is extended to the maximum in the shape of a curved fork to allow the yarn to pass in its central slot.

Further features and advantages of the invention will become apparent from the ensuing description which gives a non-limiting example thereof, which is illustrated by the accompanying drawings in which.

Figure 1:
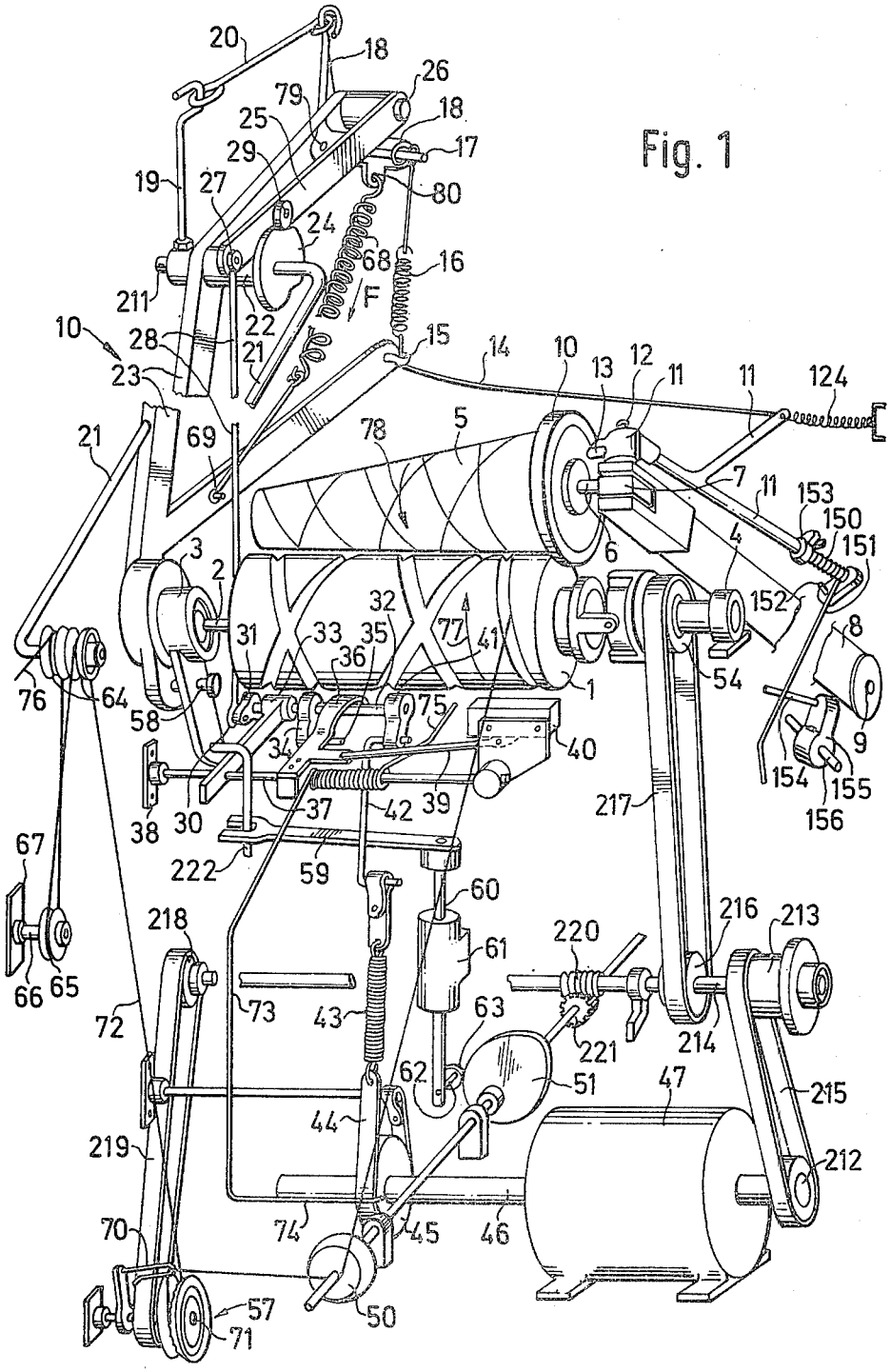
FIG. 1 is a diagrammatic perspective view of the winding machine arrangement.

The winding machine is composed essentially of a rotary grooved yarn-guide 1 rotating about a shaft 2 arranged between the bearings 3 and 4 and of a bobbin holder 5 mounted so that it is able to rotate about the shaft 6 fixed by known means 7 to an arm 8 which is able to oscillate about the shaft 9 fixed to the machine. Also secured to the bobbin holder 5 is a rubber washer 10, opposite which is arranged a lever 11 freely mounted on the shaft 12 fixed to the bobbin holder arm 8. Fixed to one of the ends of the lever 11 is a traction spring 124 which is anchored at a fixed point of the machine. A finger member 13 which may penetrate the washer 10 is fixed to the body of the lever 11.

The end of the lever 11, where the spring 124 is attached, is connected to a cable 14 passing through an eye 15 and extended by a spring 16 connected to a journal 17 fixed to an angle iron 18 oscillating about a shaft 79 connected to a second lever 19 by a connecting rod 20. The lever 19 oscillates on a shaft 211 pivoting in a socket 22 forming part of the body of the frame 23. On the other side of the frame 23, the shaft 211 is extended by a crank lever 21. Also secured to the shaft 211 is a cam 24 which acts on a roller 29 fixed to a lever 25 which is able to oscillate at one end about the shaft 26 secured to the body of the frame 23. It will be understood that the shafts 26 and 79 are generally different. Secured to the other end of this oscillating lever is a journal 27 on which pivots the end of the vertical connecting rod 28, whereof the other end 30 acts on a crank 31 integral with the shaft 32. Said shaft 32 rotates freely in a bearing 33. Fixed to the shaft 32 is a second lever 34 provided with a lug 35 which passes under a plate 36 which may pivot about the shaft 37 fixed at 38 to the frame 23 of the machine.

The small plate 36 also passes under a second plate 39 integral with a micro contact 40 fixed to the shaft 37.

Also provided on the shaft 32 is a crank 41, whereof the end actuates a connecting rod 42 integral with a spring 43 attached to a strap 44 which surrounds a pulley 45 fixed to the shaft 46 of the control motor 47.

Fixed to the shaft 46 is a pulley 212 controlling another pulley 213 fixed to the shaft 214 by means of a belt 215. The pulleys 212 and 213 are preferably stepped pulleys, in oredr to be able to vary the speed of the winding machines. Fixed to the shaft 214 is a second pulley 216 which controls a pulley 54 by a belt 217. Fixed to the other end of the shaft 214 is a third pulley 218 which controls the pulley of the feed device 57 by means of the belt 219. Also fixed to the shaft 214 is an endless screw 220, controlling a wheel having an endless screw 221 on the shaft of which is fixed a rotary oiling system 50 and a cam 51.

To render the starting gradual, a clutch comprising counterweights is provided, comprising a spring allowing adjustment of a pre-application of the counterweights on the drive path of the pulley which drives the yarn-guide and the other parts of the machine.

Figure 15:
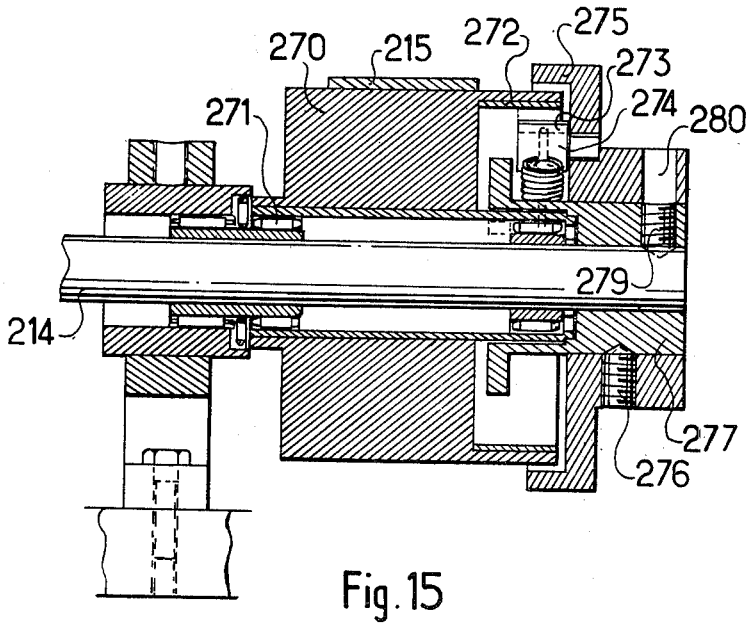
FIGS. 15 and 16 are longitudinal and radial cross-sections of a gradual starting clutch, respectively.
Figure 16:
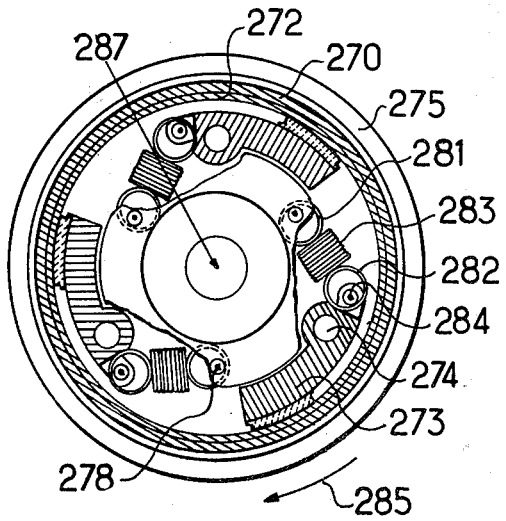

The pulley 213 will thus be composed of three main parts (FIGS. 15 and 16): a pulley body 270 driven by the belt 215, this pulley 270 rotating freely about the shaft 214 and on bearings 271. Fixed inside this pulley 270 is a ring or drum 272 serving as a path for the drive of the pulley by the counterweights 273. The counterweights 273 pivot freely on lugs 274 fixed to a circular member 275. This member 275 is secured by means of the screw 276 to a ring 277 having a cheek. Fixed to the cheek of the ring 277 are lugs 278 and said ring 277 is locked on the shaft 214 by means of the screw 279, which is accessible through the aperture 280 in the member 275. The turns 281 and 282 of the traction spring 283 are connected one to the lug 278 of the member 277 and the other to a lug 284 fixed to the counterweights 273.

Thus, by loosening the screw 276 and pivoting the member 275 about the member 277, the traction of the spring 283 is increased or reduced and the counterweights 273 are applied to a greater or lesser extent against the drive path or drum 272. Thus, whilst rotating the pulley 270 in the direction of arrow 285, the belt 215 will drive the member 275 by friction and to a greater or lesser extent according to the tension of the spring, which part 275 will in turn drive the member 277 and consequently the shaft 214. As the member 275 picks-up speed, the centrifugal force developed by the counterweights will increase and the adhesion will thus be better, which makes it possible to have adequate adhesion at the various speeds desired for the machine.

Finally, the centre of the lug 274 is located closer to the centre 287 of the arrangement than the drive path 272, thus, when the pulley 270 is braked abruptly, the counterweights tend to separate under the effect of friction and suitably brake the member 275 and consequently the shaft 214 and consequently the yarn-guide 1.

Since the spring 283 always keeps the counterweight 273 in contact with the path 272, even when stopped, braking of the counterweights on the member 275 is ensured until complete stoppage.

The cam 51 serves to oscillate the bearing 3 of the shaft 2 of the yarn-guide 1 about the shaft 58 fixed to the frame of the machine. This movement is caused by the forked lever 59, whereof the fork houses a rod of the bearing 3 and which pivots on a shaft 60 rotating in the bearing 61 fixed to the frame 23, the shaft 60 being provided with an angle journal 62, on which rotates a roller 63 constantly in contact with the cam 51.

Figure 5:
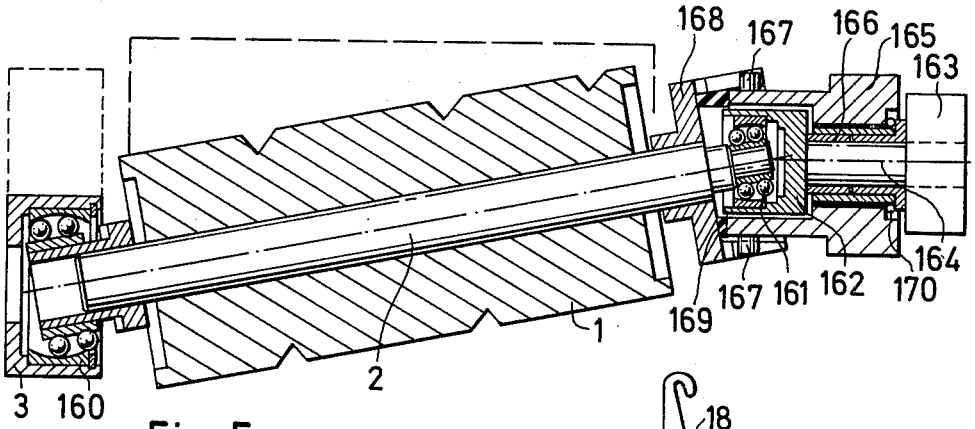
FIG. 5 is a sectional view of the oscillating shaft.

On the other hand, the shaft 2 (FIG. 5), to which the yarn-guide is secured, has its oscillating end fixed in a bearing 160 having a ball and socket joint, integral with the bearing 3, whereas the other end is fixed in a second bearing 161 having a ball and socket joint, which is integral with a bearing 162 fixed in a member 163 integral with the frame 23.

Rotating loosely on the shank 164 of the member 163 is a pulley 165 mounted on needles 166. This pulley 165 is provided with two lugs 167 passing through slots provided in the ring 168 fixed to the shaft 2.

A resilient annular gasket 169 is fitted inside the ring 168 and bears against the side of the pulley 165. This flexible gasket makes it possible to eliminate lateral displacement of the pulley 165, which also comes to bear against a thrust ball bearing 170 arranged concentrically around the shaft 164 integral with the member 163.

Thus, the shaft 2 is held in a laterally flexible manner and, by means of the two bearings comprising ball and socket joints, may oscillate freely. Since the speed of rotation of the member 168 is equal to that of the pulley 165, the resilient gasket does not suffer in any way, secondly, the lugs 167 are provided with rings of self-lubricating material, being able to rotate freely about themselves, which ensure long usage owing to almost inexistent wear, despite the high speed of rotation of the cylinder. With the same desire for a long life of the members, the ball bearings and bearings having a ball and socket joint are chosen such that the speed at which they are used is much less than their maximum.

This oscillation system serves to eliminate the superimposed winding of turns at the same point which forms a fault known commonly as a "ribbon" in technical language, especially if the oscillation of one of the ends of the yarn guides takes place in a plane substantially perpendicular to the plane defined by the axes of the bobbin and of the yarn-guide, when they are in this plane.

But this oscillation of the yarn-guide may cause other faults, such that the yarn jumps out of the grooves of the yarn-guide, because it is insufficiently controlled.

This is why (see FIG. 6) a tensioning guide is added for keeping the yarn in the grooves, whatever the position of the yarn guide.

This tensioning guide (see FIGS. 6, 7, 8, 9 and 10), disposed between the tensioning members of the yarn and the yarn-guide, will simultaneously cause more intensive tightening at the point where tensioning of the yarn will be undertaken.

This is why, in the case of a conical bobbin, the oscillation of the yarn guide will be undertaken at the side of the yarn-guide located towards the small diameter of the bobbin, in order that the complementary tightening is carried out at the same point where the yarn is subject to a lower speed, but, also, it will be noted that when the bobbin is empty, the speed difference between the large diameter and small diameter of the bobbin is clearly greater than when the bobbin is full. It is thus advantageous if the tensioning action of the tensioning guide varies as the bobbin is filled.

Mounted on the journal 222 of the bearing 3 are oscillating means 223, on which is fixed the tensioning guide 224 and another rod 225 bent at right-angles at its end 226. The end of the rod 225, forming a pivot pin, is located essentially at the same level as the lower generatrix 227 of the yarn-guide 1.

The right-angled end 226 of the rod 225 serves as a pivot for a cranked connecting rod 228, whereof one end winds in the form of a loop around the right-angle 226, and the other end 229 serves as a pivot for a flexible connecting rod 230, fixed to an arm 231 integral with the arm 8 supporting the bobbin 5. The arm 8 pivots about the shaft 9 such that the movement of the bobbin 5 in the direction of arrow 232 produces an oscillation of the arm 231 in the direction of arrow 233.

Fixed to a cross piece 234 of the winding machine is a member 235 to which is secured in an adjustable manner, a hook 236, the end of which may serve as an abutment 237 for the cranked connecting rod 228.

Thus, for the same diameter of bobbin, the pivot 226 controls the position of the inclined rod 224 with respect to that of the yarn-guide.

Since this pivot 226 is located virtually at the level of the generatrix 227 of the yarn-guide 1 when the bearing 3 oscillates about its pivot 58 in the direction of arrow 238, in order to cause the yarn-guide 1 to oscillate, the rod 224 moves at the same time as the yarn-guide 1 and remains in the same position relative to the latter at any time of its oscillation.

In this manner, the yarn is always retained in the same way in the grooves of the yarn-guide and is thus always guided perfectly.

Figure 6:
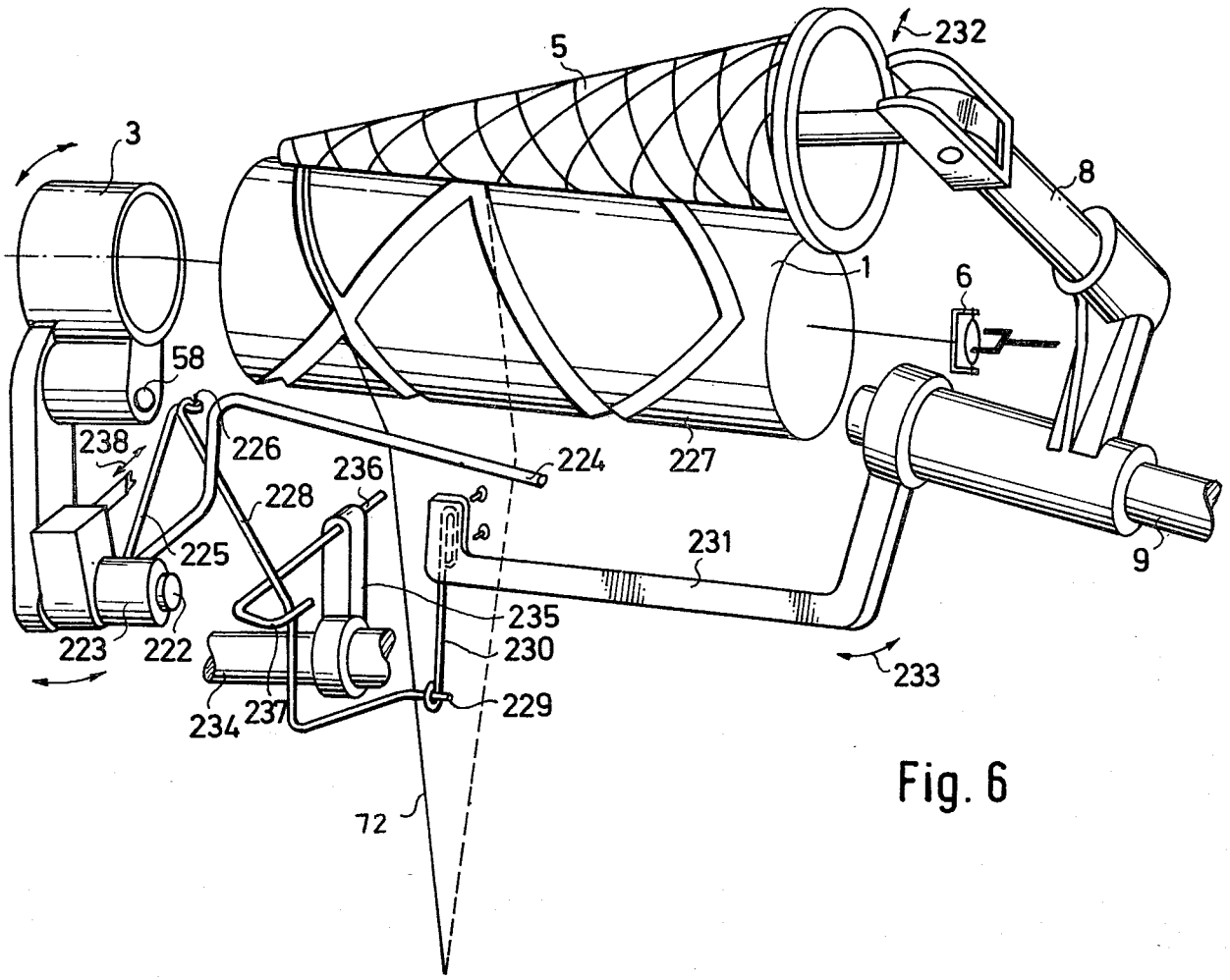
FIG. 6 is a perspective view of the main parts of the winding machine, namely the bobbin holder and the yarn guide with its control members.
Figure 7:
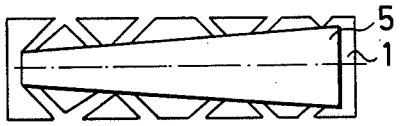
FIG. 7 is a diagrammatic plan view of a bobbin and of the grooved yarn-guide when their shafts are in the same plane.
Figure 8:
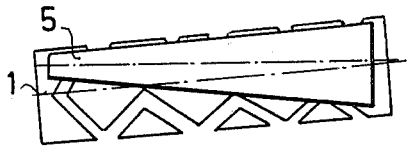
FIGS. 8 and 9 are diagrammatic views similar to those of FIG. 7, showing two positions of extreme oscillation of the grooved yarn-guide.
Figure 9:
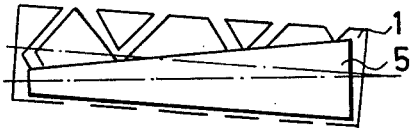

Furthermore, in FIG. 6, it can be seen that when the arm 8 is raised, the flexible connecting rod 230, controlled by means of the lever 231, pushes the connecting rod 228 forwards, imparting, by means of the pivot 226 and lever 225, another forward movement of the inclined rod 224, which reduces the tensioning effect on the yarn by this rod when the yarn-guide winds the yarn on the small diameter of the bobbin.

Nevertheless, the pivot 226 always remains at a point (close to the pivot 58) such that in practice pivoting of the journal 222 does not change the position of the rod 224 with respect to the yarn-guide at any points of oscillation of the latter.

If desired, it is possible to displace the pivot 226 more rapidly at the beginning of the formation of the bobbin. For this, it is sufficient if the length of the flexible connecting rod 230 is clearly greater than that of the lever 225. But since a time would arrive when the tensioning rod 224 would no longer be in contact with the yarn and thus no longer ensure sufficient retention of the yarn in the grooves of the oscillating yarn-guide 1, the abutment 237 is adjusted such that at a certain time, the pivot 226 is immobilised whereas the pivot 229 is also locked, the flexible connecting rod 230 allowing the arm 8 to continue its pivoting movement without any drawbacks during the remainder of the formation of the bobbin.

Figure 10:
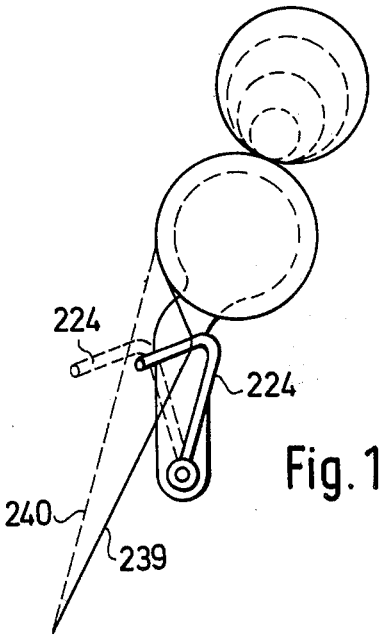
FIG. 10 is a side view of the bobbin of the yarn-guide and of the tensioning guide.
Figure 11:
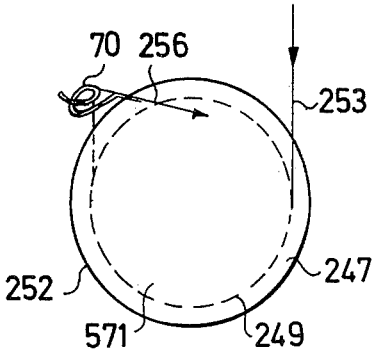
FIG. 11 is a diagrammatic view of a pulley according to the invention.
Figure 12:
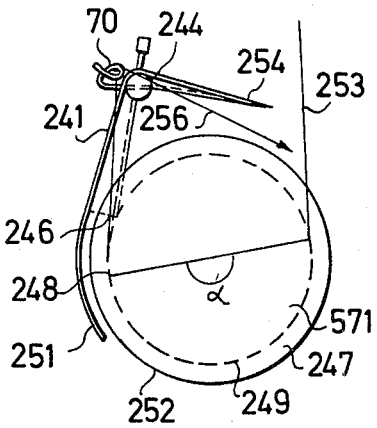
FIG. 12 is a diagrammatic view of the same pulley according to the invention.
Figure 13:
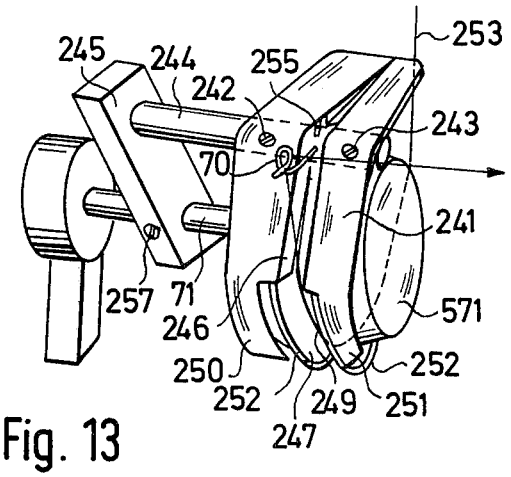
FIG. 13 is a perspective view of the feed device of the invention.
Figure 14:
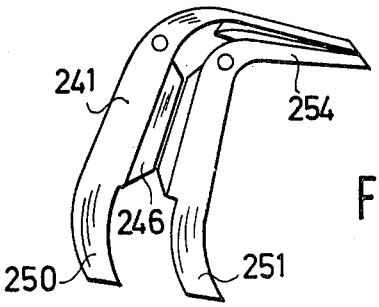
FIG. 14 is a perspective view of the means for covering the only pulley of the feed device.

The diagram of FIG. 10 shows in full line the yarn 239 when the rod 224 is in the position of maximum tensioning (empty bobbin) and in dot-dash line the yarn 240 when the tensioning rod 224 is in the position of minimum tensioning, (full bobbin or a bobbin having a sufficient diameter for the tensioning to become minimum).

Small wheels 64 are secured to the end of the oscillating lever 21, so that they may rotate freely, opposite which is located another small wheel 65 rotating freely on a journal 66 fixed at 67 to the frame 23. The oscillating lever 21 is constantly drawn upwards by the lever 19, connecting rod 20, lever 18 and spring 68, which acts in the direction of arrow F, connected to the frame 23 at 69.

Figure 3:
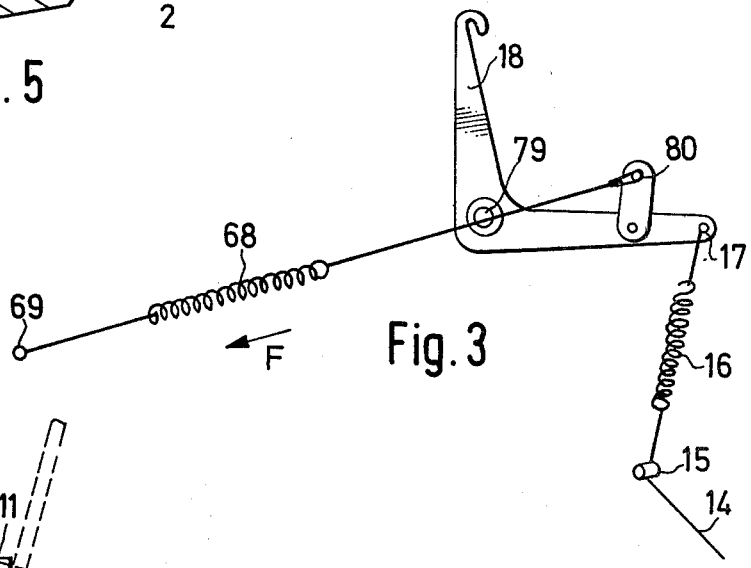
FIG. 3 is a diagrammatic view of part of the mechanical connecting device between the oscillating lever and the braking finger member, in the winding position.
Figure 4:
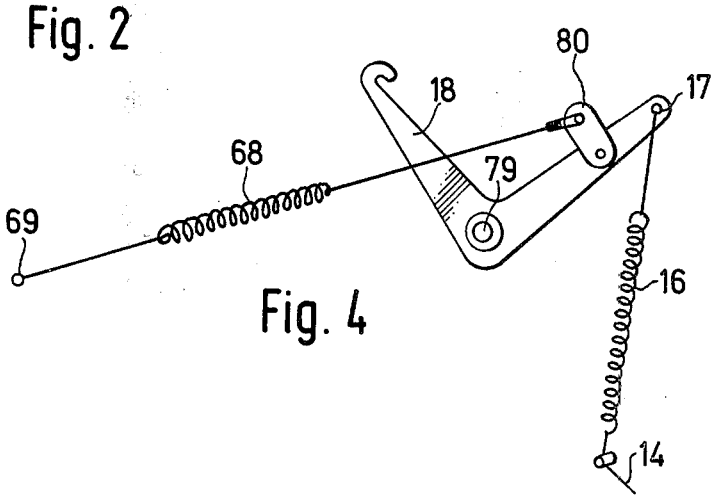
FIG. 4 is a diagrammatic view of the same device as in FIG. 3, in the braking position.

However, (FIG. 3), according to a variation, the point of attachment of the spring 68 to the right-angled lever 18 is located at 80 such that the straight line passing through the points 69 and 80 passes slightly below the pivot point 79 of the right-angled lever 18. Thus, when the yarn 72 urges the lever 21 downwards, subsequent to the yarn becoming tangled as it is supplied, from the beginning of the oscillation of the arrangement 21, 19, 20, 18 for example, the alignment 80 – 69 passes almost immediately above the axis or pivot 79, such that the spring 16 is immediately urged to brake the bobbin 1 with a force resulting from the combined action of the spring 68 and that provided by the arrangement 21, 19, 20, 18 under the effect of the contraction of the yarn (FIG. 4). Thus, the tension required of the yarn for stopping the bobbin and then the winding machine is limited, which promotes the efficiency of the braking action and makes it possible to increase the winding speed with automatic stoppage in the case of tangling of the yarn. A cover 241 is fixed by screws 242, 243 to a support 244 retained by an arm 245. In its central part, the cover 241 comprises a groove in the shape of a ladle 246 engaging in the groove 247 of the pulley 571 coming as close as possible to the point 248 where the yarn leaves the base of the groove 249 of said pulley 571. The cover 241 extends beyond the ladle 246 in the form of a fork with two teeth 250, 251, which cover the outer edges 252 of the groove. Likewise, the cover 241 extends beyond the support 244, in the opposite direction to the ladle 246, to partly cover the pulley on the side of the strand of yarn 253 entering the pulley. It is possible to ensure maximum extension in this direction by forming this rear part 254 having a cover 241 with a central slot to allow the strand 253 to pass.

A device for regulating the apparatus is also provided, by pivoting the arm 245 about the shaft 71 and thus immobilising this arm by means of a screw 257.

In this way, it will be seen that there is virtually no more space allowing the passage of the yarn between the base of the ladle 246 and the base of the groove 249. This space may be reduced to a distance of the order of a millimeter and even less, thus preventing any risk of tangling of the yarn or a resulting lump. The yarn-guide 70 engages in a hole in the support 244 and is immobilised by the screw 255. The regulation of this yarn-guide and the dimensions of the ladle 246 are such that the strand 256 becomes flush with the edge of this ladle 246. Nevertheless, it is necessary that this distance is not too slight so that the yarn does not become ruffled. By means of this arrangement, it is possible to ensure a maximum efficiency of the feed device by giving the angle $\alpha$ the largest possible value.

If the strand of yarn 256 should break, the rear part 254 serves to push the yarn back and prevent it from falling into the groove 247 of the pulley 571. It will also be seen that the major part of the pulley 571 is protected by the cover 241, but the latter comprises notches necessary for allowing it free access and not hindering the entry and exit of the yarn. It should also be noted that regulation of the angular position of the arm 245 about the shaft 71 by means of the screw 257 is sufficient to ensure that the best possible position of the arrangement and, in particular, to modify the value of the angle $\alpha$ for making it the useful maximum.

A yarn break detector 73 is provided so as to be able to oscillate on the shaft 37. The end of the yarn break detector 73 is folded back at right-angles at 74 and the other end terminates in a tail 75 passing under the strip 39 of the micro contact 40 for the supply of the motor 47. The micro contact 40 actuates the contact-maker of the motor, which contact maker is not shown in the drawings.

The operation of the winding machine will now be explained.

The yarn 72, coming from any supply represented by the arrow 76, passes over a first small wheel 64 at the end of the lever 21, then over the fixed small wheel 65 and then onto a second small wheel 64 at the end of the lever 21 to form the regulating loop. The yarn then passes around the feed device 57, retained by the guide 70, then passes around the oiling device 50 then rests against the angle member 74 of the yarn break detector 73 in order to wind onto the bobbin 5 whilst bearing in a groove of the grooved yarn-guide 1. The yarn-guide 1 rotates in the direction of arrow 77 and the adhesion rotates the bobbin 5 in the direction of arrow 78.

Figure 2:
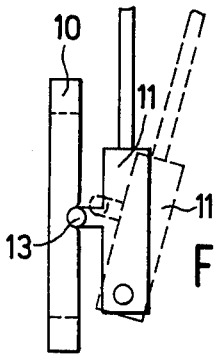
FIG.2 is a diagrammatic detailed view of the bobbin brake.

When the yarn unwinds normmally from its supply, the roller 29 is located in the hollow of the cam 24. The right-angled lever 18 is in the inoperative position. The spring 16 and the cable 14 are slack and consequently the lever 11 is in the position shown in broken line in FIG. 2, i.e. the finger member 13 in disengaged from the rubber ring 10 fixed on the bobbin support 5. During this operation, the yarn break detector 73 is raised forward such that its tail 75 is lowered and does no act on the strip of the micro contact 40 which keeps the electrical circuit for controlling the motor 47 closed.

In the same way, since the roller 29 is in the hollow of the cam 24, the lever 25 is lowered, like the connecting rod 28 and the crank 31, such that the lever 34 is in the lower position and keeps down the strip 36 which no longer acts on the strip 39 of the micro contact 40.

Furthrmore, since the crank 31 is lowered, the same is true for the crank 41 and the connecting rod 42 which leaves the spring 43 slack and the belt 44 which does not act on the pulley 45, such that the motor 47 may rotate freely.

If the yarn 72 should break or be cut in the supply, the yarn break detector 73, 74 drops and its rear part pivots upwards thus raising the strip 39 of the micro contact 40 which opens the electrical circuit, thus causing stoppage of the motor 47.

If, for any reason, the yarn is tangled as it is supplied and begins to stretch, the loop which it forms around the pulleys 64 and 65 becomes shorter and pulls the lever 21 downwards. The cam 24 pivots and thus pushes the roller 29 upwards, thus raising the lever 25, which raises the connecting rod 28. The shaft 32 is thus influenced so that the cranks 31, 34 and 41 are raised, which has the effect, as already seen, on the the hand of raising the strip 36 and strip 39, which acts on the micro contact 40 to open the circuit of the motor 47 and stop it, and secondly, of raising the connecting rod 42 by pulling on the spring 43 and belt 44 which rests on the pulley 45, which rapidly brakes the motor 47 and pulley 213.

Furthermore, the lever 21, descending under the effect of the exaggerated traction of the yarn 72, causes the lever 19 to oscillate forwards, which lever pulls on the connecting rod 20, which in turn causes the right-angled lever 18 to pivot, thus raising the journal 17 fixed to said lever. The journal 17 pulls on the spring 16 and cable 14. Since the spring 16 has a greater force than the spring 124, the lever 11 is acted upon abruptly and the finger member 13 engages in the rubber ring 10 fixed to the bobbin 5. To make the braking action more rapid and more powerful, the distance between the finger member 13 and ring 10 is adjusted such that the bobbin 5 is braked even before the winding machine itself has had time to stop, i.e. even before the stoppage of the yarn-guide 1. Consequently, the yarn 72 is thus slack between the feed device 57 and yarn-guide 1, in the region of the oiling device 50 and the risks of breakage are thus eliminated.

In addition, yarn is prevented from falling off the ends of the bobbin 5, since if the bobbin slowed down less slowly than the yarn-guide 1, the crossing of the yarn on the bobbin would be elongated and as ascertained on current winding machines, the yarn would fall off at the ends.

The more powerful the braking of the bobbin, the better will be the result. Tests have shown that braking of the finger member 13 on a rubber ring 10, which was relatively soft, was very forceful and gave the best results.

The action of the brake is powerful and rapid and the force developed by the yarn 72 is amplified considerably by the lever system 21 and the entire kinematic chain which starts from the latter and terminates at the lever 11. It may be increased by the relative arrangement of the points 69, 79 and 80, which was explained above.

Naturally, when the motor 47 is stopped, the same is true for the endless screw 220 and the wheel 221, as well as the pulley 212 and belt 215 and the pulleys 216 and 218. The oiling device 50 is thus stopped, like the feed device 57.

This is where a wise position of the lug 274 for pivoting the counterweights with respect to the drive path 272 is important because, since the pulley 270 has been abruptly stopped, the counterweight support will continue by inertia in the direction of arrow 285, but the sliding direction of the counterweights changes and the latter tend to rise and lock. In this way, the yarn-guide 1 is stopped sufficiently quickly so as not to damage the material on the bobbin.

When the traction on the yarn 72 has stopped, the lever 21, urged by the spring 68, draws back the righ-angled lever 18 and consequently the lever 19 by rotating the shaft 211 and drawing the lever 21 upwards. Nevertheless, it may be objected that in the position of FIG. 4, the traction of the spring 68, in the initial part of the movement, cannot act in this direction. However, at this instant, the journal 17 is also subjected to the preponderant pulling force of the spring 16, of the cable 14 and of the spring 124. The movement may thus take place. The cam 24 oscillates such that the roller 29 is located in one of its hollows and the lever 25 drops, thus controlling lowering of the connecting rod 28 and lowering of the cranks 31, 34 and 41, which re-assume their first position and simultaneously cause lowering of the cam 39 for controlling the micro contact 40, which re-establishes the electrical circuit and lowering of the connecting rod 42 which releases the spring 43 and disengages the belt 44 from the pulley 45, by releasing the brake and allowing the motor 47 to rotate. Finally, since the cable 14 and spring 16 are slack, the spring 124 may draw back the lever 11 and disengage the finger member 13 from the ring 10, such that the bobbin 5 may once more rotate freely.

However, it appears that in order to prevent yarn from falling from the ends of the bobbin, it is necessary to bring about complete stoppage of the bobbin before that of the yarn-guide. However, this stagger in the stoppages must be extremely small, otherwise the yarn-guide will rub in an exaggerated manner on the outer surface of the bobbin at its point of contact with the latter and disturb the last turns of yarn wound just before the stoppage, sometimes to the point of forming a loop of yarn.

Now, since braking of the bobbin is constant, it is obvious that it will be less efficient when the bobbin is full, since it will offer greater inertia to be overcome in order to stop it, than when it is almost empty.

This will be to the extent that an adjustment in braking of the bobbin which is satisfactory for a bobbin which is almost empty, will no longer be so when it is full and vice versa.

It has thus appeared necessary to combine differential braking of the bobbin according to its state of formation, ie. to its diameter.

This is why it has been proposed to locate on the arm 11, a torsion spring 150 whereof the end 151 rests on an abutment 152 whereas its other end enters a ring 153, which makes it possible to regulate the force of the spring, supported by the end 151 on the abutment 152.

Another rod 154 fixed by the members 155 and 156 at any point of the frame 23 of the winding machine, also serves as an abutment for the end 151.

It will be seen that when the axis of the bobbin 5 moves away from the yarn-guide 1 as the yarn is wound on the bobbin, the point of application of the end 151 of the spring 150 will move away from the axis of this spring. Consequently, when the rod 11 is urged by the spring 16 to brake the bobbin by means of the finger member 13 (FIG. 2), the force of application of this finger member on the rubber 10 will increase as the bobbin becomes larger, since the force of the spring 150 opposing that of the spring 16 will decrease as the axis of the bobbin 5 moves away from the yarn-guide 1.

Herein the term adhesion, for example, with respect to the yarn-guide driving the bobbin thereby is to be understood as driving by frictional resistance.

While I have disclosed several embodiments of the present invention it is to be understood that these embodiments are given by example only and not in a limiting sense.

I claim:

1. In a winding machine having independent spindles with a control motor, and cooperative actuating members driving a grooved yarn-guide, the latter in turn driving bobbins preventing winding irregularities of yarn which is supplied and then fed to the bobbins winding at high speeds from hanks, cops, cakes or the like, namely winding machines having a conical bobbin which rests on a cylindrical yarn-guide having helical grooves generally with two opposing pitches which distributes the yarn uniformly on the bobbin, the latter resting under its own weight above the yarn-guide which drives the bobbin by frictional resistance, the yarn-guide and the bobbin, respectively, being mounted on a shaft having ends, and defining two axes, respectively, the axis of the bobbin moving progressively away from the axis of the yarn-guide as the yarn is being wound while forming normally in a plane common to the two axes a small or zero angle with the axis of the cylindrical yarn-guide, including a device for preventing the yarn from collecting at certain preferential points of the bobbin at certain winding speeds, and including a yarn break detector, the improvement comprising means for oscillating at least one of th ends of the shaft of the yarn-guide and of the bobbin with an alternating relative oscillatory movement substantially perpendicular to an operative plane defined by the two axes of the yarn-guide and of the bobbin, respectively, without causing any substantial vertical oscillation of the bobbin, modulated action means operatively cooperating with the oscillation of the yarn-guide and of the bobbin, respectively, for retaining the yarn in a groove of the yarn-guide for any operative positon of the axis of the yarn-guide with respect to the axis of the bobbin, second means, in operative combination with said modulated action means, for preventing a faulty movement of the yarn with respect to the axis of the bobbin both at a time of starting and at a time of braking, comprising torque converter means for providing a uniform and moderate torque on the yarn-guide at the time of starting, automatic braking means for intensive simultaneous stopping of said control motor, of said bobbin, and of said yarn-guide and said cooperative actuating members as soon as a predetermined exaggerated traction is exerted by the yarn which is supplied, said automatic braking means for braking the bobbin abruptly and with priority, and means for tensioning the yarn which is fed for preventing slipping thereof.

2. The improvement, as set forth in claim 1, wherein said torque converter means includes a driving part, said torque converter means for providing a low torque upon starting the machine, as well as providing a considerable resisting torque during braking of said driving part.

3. The improvement, as set forth in claim 2, wherein said torque converter means includes, a drum operatively connected to said driving part, a driven part, oscillating jaws means for pressing, under the effect of centrifugal force, against an inside of said drum, said oscillating jaws means being integral with said driven part, and spring means for adjustably constantly cooperating with said oscillating jaws means for producing a wedging effect against said drum, considerably increasing the torque transmitted by said converter means during a restaining operation thereof with respect to its drive operation.

4. The improvement as set forth in claim 3, wherein said conical bobbin has a small diameter end, said oscillating means further for producing an oscillation of said yarn-guide adjacent said small diameter end of said bobbin.

5. The improvement, as set forth in claim 4, wherein said conical bobbin has a small diameter end, said yarn-guide has a movable end operatively connected to said oscillating means and oscillating therewith, and said modulated action means comprises a movable tension guide means disposed adjacent said yarn-guide in front of an inlet of the yarn which is fed into a groove of said yarn-guide, said tension guide means being inclined for increasing tension towards said small diameter end of said bobbin on said yarn and including means for providing two superimposed movements for controlling the tension on said yarn constituting oscillations corresponding to the oscillation of said movable end of said yarn-guide as well as progressive divergence of said yarn-guide as said bobbin becomes larger from the yarn being wound thereon.

6. The improvement, as set forth in claim 1, wherein said conical bobbin has a small diameter end, said yarn-guide has a movable end operatively connected to said oscillating means and oscillating therewith, and said modulated action means comprises a movable tension guide means disposed adjacent said yarn-guide in front on an inlet of the yarn which is fed into a groove of said yarn-guide, said tension guide means being inclined for increasing tension towards said small diameter end of said bobbin and for oscillating corresponding to the oscillation of said movable end of said yarn-guide.

7. The improvement, as set forth in claim 1, wherein said modulated action means comprises a movable tension guide means disposed separated and adjacent with respect to said yarn-guide and includes means for rapidly varying the separation of said tension guide means with respect to said yarn-guide at a beginning of an enlarging of said bobbin for stabilizing a remainder of said bobbin throughout winding of said yarn on said bobbin.

8. The improvement, as set forth in claim 1, wherein said automatic braking means includes a fixedly mounted return pulley and a resiliently biased oscillating lever means having an end spaced from said return pulley for controlling upon oscillation thereof the stopping and braking of said control motor, of said bobbin and of said yarn-guide in response to an excess tension of the yarn which shortens a loop of said yarn formed between said return pulley and said end of said oscillating lever means for causing said oscillating lever means to oscillate, for actuating said stopping and braking.

9. The improvement, as set forth in claim 8, a resilient ring integrally secured to said bobbin concentric thereto, a finger member means movably disposed adjacent said ring for engaging in the latter for the braking of said bobbin, said oscillating lever means for actuating said finger member means such that the latter engages in said ring.

10. The improvement, as set forth in claim 9, wherein said automatic braking means further includes means for increasing a braking force of said finger member means on said bobbin as said bobbin becomes larger from the yarn being wound thereon.

11. The improvement, as set forth in claim 9, further comprising means for multiplying force on said finger member means and operatively disposed between said oscillating lever means and said finger member means.

12. The improvement, as set forth in claim 11, wherein said force multiplying means comprises a return spring means operatively mounted for biasing said oscillating lever means and passing through a position of unstable equilibrium, and for acting in a same direction as the loop of the yarn.

13. The improvement, as set forth in claim 12, further comprising an other shaft of the yarn-guide, at least one of said shafts of the yarn-guide oscillates about one of the ends thereof, and means for movably mounting the other of said ends of said at least one shaft for undergoing a pivotal movement ensuring oscillation under predetermined conditions.

14. The improvement, as set forth in claim 13, wherein said other end of said at least one shaft constitutes a substantially fixed end relative to said one end, a universal joint means for rotatably and pivotally mounting said other end of said at least one shaft about said universal joint means, said other shaft is non-oscillatorily mounted and constitutes means in cooperation therewith for rotatably driving said at least one shaft.

15. The improvement, as set forth in claim 14, wherein said other of said shafts is non-rotatably and non-oscillatorily mounted and constitutes a fixed shaft, a bearing comprising a ball and socket joint fitted in said fixed shaft, said at least one of said shafts is operatively disposed in said bearing, a drive pulley rotatably mounted on said fixed shaft, said drive pulley has lugs, and a circular ring secured to said at least one shaft formed with apertures in which said lugs engage, whereby said at least one shaft is rotatably driven by said drive pulley.

16. The improvement, as set forth in claim 15, wherein said drive pulley is formed with circular shoulder having said lugs arranged thereon, and said circular ring having said apertures therein partly overlaps said circular shoulder with said lugs engaging in said apertures thereat.

17. The improvement, as set forth in claim 16, wherein said circular ring includes a base thereof, a flexible circular gasket disposed between said base of said circular ring and an end of said circular shoulder.

18. The improvement, as set forth in claim 17, further comprising an axle of rotation of said drive pulley is formed with a lateral shoulder, a needle bearing is disposed between said drive pulley and said lateral shoulder, and said gasket constitutes a resilient gasket means for operatively pressing said drive pulley against said needle bearing.

19. The improvement, as set forth in claim 14, further comprising a bearing having a ball and socket joint in which said one end of said at least one shaft is mounted, and an oscillating bearing in which said ball and socket joint is mounted.

20. The improvement, as set forth in claim 8, further comprising a yarn feed means for being actuated in synchronism with said yarn-guide and operatively disposed between said loop and said yarn-guide and comprising a diabolo in a manner as a feed pulley and having staggered projections, and an adjustable guide means for determining a winding sector of the yarn on said feed pulley.

21. The improvement, as set forth in claim 8, further comprising a ribbon brake means for strongly braking said control motor when actuated, and said oscillating lever means further for actuating said ribbon brake means.

22. The improvement, as set forth in claim 1, further comprising a feed device comprising a grooved pulley means rotatably mounted for pulling the yarn which is adapted to be partly wound thereon, and at least one yarn guide means for guiding the yarn partly wound on said grooved pulley means at an outlet therefrom and an inlet thereto, a fixed cover means covers said pulley means over a sector thereof unwound with the yarn for moving closely adjacent to said yarn and said pulley means as possible without contact to a point where the yarn leaves said pulley means.

23. The improvement, as set forth in claim 22, wherein said pulley means is formed with a groove defining a base thereof in which the yarn is party wound and enters and leaves therefrom, said cover means has a shape substantially conforming to a portion of said pulley means and has a shape adjacent the outlet of the yarn therefrom forming a ladle portion, the ladle portion entering in said groove of said pulley means close to the point where the yarn leaves the base of said groove of said pulley means.

24. The improvement, as set forth in claim 23, wherein said pulley means is formed with edges defining said groove, and said cover means includes a curved fork-shaped portion which extends beyond said ladle portion above the edges of said pulley means.

25. The improvement, as set forth in claim 23, further comprising a pulley shaft on which said pulley means is disposed, a support means for being adjustably rotatably mounted about said pulley shaft by pivoting about said pulley shaft, said support means for retaining said cover means thereon.

26. The improvement, as set forth in claim 25, wherein said cover means has a rear part which extends beyond said support means in a direction opposite to said ladle portion for partly covering said pulley means at the inlet of the yarn to the pulley means.

27. The improvement, as set forth in claim 26, wherein said rear part of said cover means extends to a maximum in the form of a curved fork having a central slot, the latter adapted to pass the yarn therethrough.

* * * * *